US008201505B2

(12) United States Patent
Long

(10) Patent No.: US 8,201,505 B2
(45) Date of Patent: Jun. 19, 2012

(54) COUNTERBALANCE APPARATUS

(76) Inventor: Dennis L. Long, Grand Rapids, MI (US)

( * ) Notice: Subject to any disclaimer, the term of this patent is extended or adjusted under 35 U.S.C. 154(b) by 479 days.

(21) Appl. No.: 12/546,958

(22) Filed: Aug. 25, 2009

(65) Prior Publication Data

US 2011/0048291 A1 Mar. 3, 2011

(51) Int. Cl.
*A47B 9/00* (2006.01)

(52) U.S. Cl. ..... 108/147; 248/188.2

(58) Field of Classification Search ..... 108/147, 108/20, 50.01; 312/319.1, 319.4–319.5, 312/319.7–319.8, 223.3, 194; 248/188.2, 248/188.5, 157, 161, 162.1
See application file for complete search history.

(56) References Cited

U.S. PATENT DOCUMENTS 3,191,902 A 6/1965 Goller
3,285,207 A 11/1966 Vom Hagen et al.
3,521,341 A 7/1970 Hornlein et al.
5,282,593 A * 2/1994 Fast ..... 248/188.4
5,682,825 A * 11/1997 Manner ..... 108/147
5,718,406 A 2/1998 Long
5,941,182 A 8/1999 Greene
6,026,755 A 2/2000 Long
6,289,825 B1 9/2001 Long
6,378,446 B1 4/2002 Long
6,484,648 B1 11/2002 Long
6,545,880 B1 * 4/2003 Mueller ..... 363/14
6,584,917 B2 7/2003 Long
7,412,931 B2 8/2008 Seidl et al.

OTHER PUBLICATIONS

International Search Report and Written Opinion of the International Searching Authority; PCT/US10/031679; dated Jun. 16, 2010.

* cited by examiner

*Primary Examiner* — Hanh V Tan

(57) ABSTRACT

A counterbalance apparatus for use in a workstation to raise and lower a work surface of the workstation. The counterbalance apparatus compensates for the load on the work surface. The counterbalance apparatus includes an inner column telescopingly mounted in an outer column. A base member is positioned at one end of the outer column. A grooved member positioned between the inner column and the base member and a force mechanism between the grooved member and the inner column or the work surface. The grooved member moves in and out of the inner column and base member to raise and lower the work surface.

28 Claims, 8 Drawing Sheets

COUNTERBALANCE APPARATUS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a counterbalance apparatus for use in moving a work surface. In particular, the present invention relates to a counterbalance apparatus for vertically moving the work surface of a workstation where the counterbalance apparatus exerts a substantially constant force on the moving work surface throughout the entire vertical travel of the work surface.

There remains a need for a counterbalance apparatus which is durable and easy to construct and which allows for easily raising and lowering a work surface and which can be mounted in the leg of a workstation.

BRIEF SUMMARY OF THE INVENTION

A counterbalance apparatus for use in a workstation to raise and lower a work surface of the workstation. The counterbalance apparatus enables a user to easily raise and lower the work surface of the workstation by applying a small upward or downward force on the work surface. The counterbalance apparatus compensates for the load on the work surface so that a relatively small force can be used to raise or lower the work surface. The force necessary to move the work surface up and down is substantially constant for all loads throughout the vertical travel of the work surface. The counterbalance apparatus includes an inner column telescopingly mounted in an outer column. A base member is positioned at one end of the outer column. A grooved member is positioned between the inner column and the base member and a force mechanism is positioned between the grooved member and the inner column or the work surface. The grooved member has first grooves which are non-linear and second grooves which are linear. The first grooves engage first rollers in the inner column. The second grooves engage second rollers in the base member. As the work surface is raised and lowered, the rollers move along the grooves and the grooved member moves in and out of the base member and the inner column. As the groove member slides in and out of the base member and the inner column, the grooved member rotates. The movement of the rollers in the grooves compensates for the additional compression force of the force mechanism to enable the work surface to be easily raised and lowered with minimal force from the user.

The counterbalance apparatus can be used in a workstation having one (1) leg or multiple legs. When the counterbalance apparatus is used in a workstation having one leg, the inner column has anti-torque rollers which prevent the inner column and the work surface from rotating as the work surface is raised and lowered in the outer column. In the embodiment where the workstation has two (2) legs, the counterbalance apparatus are connected together by an anti-racking system to ensure that the counterbalance apparatus operate together at the same rate to raise and lower the work surface. Optionally, a brake is provided for use with the anti-racking system to hold the work surface at a set height and to prevent accidental raising and lowering of the work surface. The brake can also have an out-of-balance feature which prevents the brake from being disengaged, if the load on the work surface is out-of-balance. The load on the work surface is out-of-balance when there is too much load or not enough load on the work surface based on the preload setting of the counterbalance apparatus. The force mechanism can be pre-loaded to compensate for the weight of the load on the work surface. The pre-load can provide a range of weight within which the load on the work surface is balanced. When the load is balanced, the counterbalance apparatus works to prevent the work surface from raising or lowering suddenly and enables a user, to easily raise or lower the work surface using minimal upward or downward force. When pre-loaded for the particular load on the work surface, the counterbalance apparatus applies a substantially constant force through the entire up and down movement of the work surface for any load within the range of weight.

The present invention relates to a counterbalance apparatus, which comprises an outer column, an inner column slidably mounted in the outer column and having an inner bore with a first roller in the inner bore, a base member positioned in the outer column and having an inner bore with a second roller in the inner bore, a grooved member movably mounted in the inner bore of the base member and the inner bore of the inner column and having a first end and a second end with an inner bore and a sidewall extending therebetween and having a first groove in an outer surface of the sidewall and a second groove in the outer surface of the sidewall, and a force mechanism extending between the grooved member and the inner column, wherein when the counterbalance apparatus is extended and compressed, the first roller is adapted to move along the first groove and the second roller is adapted to move along the second groove so that the grooved member rotates as the grooved member moves in the inner bore of the base member and the inner bore of the inner column.

Further, the present invention relates to a workstation which comprises a work surface, a base, one leg extending between and connecting the work surface and the base and having a counterbalance apparatus, the counterbalance apparatus including an outer column, an inner column connected to the work surface and slideably mounted in the outer column and having a first roller, a base member positioned in the outer column and having a second roller; a grooved member movably mounted in the base member and the inner column with a first end and a second end with a sidewall extending therebetween and having a first groove in an outer surface of the sidewall and a second groove in the outer surface of the sidewall; and a force mechanism extending between the grooved member and the inner column, wherein when the counterbalance apparatus is extended and compressed, the first roller is adapted to move along the first groove and the second roller is adapted to move along the second groove so that the grooved member rotates as the grooved member moves in the base member and in the inner column.

Still further, the present invention relates to a workstation having a load, which comprises, a work surface, a base, at least two legs extending between and connecting the work surface and the base wherein each of the legs includes a counterbalance apparatus, the counterbalance apparatus including an outer column, an inner column connected to the work surface and slideably mounted in the outer column and having a first roller, a base member positioned in the outer column and having a second roller; a grooved member movably mounted in the base member and the inner column with a first end and a second end with a sidewall extending therebetween and having a first groove in an outer surface of the sidewall and a second groove in the outer surface of the sidewall; and a force mechanism extending between the grooved member and the inner column, wherein when the counterbalance apparatus is extended and compressed, the first roller is adapted to move along the first groove and the second roller is adapted to move along the second groove so that the grooved member rotates as the grooved member moves in the base member and the inner column.

Further still, the present invention relates to a method of preventing a work surface of a workstation from being raised or lowered when a weight of a load on the work surface is outside of a predetermined range, which comprises the steps of providing at least a first leg and a second leg extending between and connecting the work surface and a base of the workstation, providing a counterbalance apparatus positioned in each of the first and second legs of the workstation, the counterbalance apparatus including an outer column, an inner column connected to the work surface and slideably mounted in the outer column and having a first roller, a base member positioned in the outer column and having a second roller; a grooved member movably mounted in the base member and the inner column with a first end and a second end with a sidewall extending therebetween and having a first groove in an outer surface of the sidewall and a second groove in the outer surface of the sidewall; and a force mechanism extending between the grooved member and the inner column, providing an anti-racking system extending between and connecting the counterbalance apparatus in each of the first and second legs of the workstation, providing a brake having a stop, a brake release spring connected to the stop, a braking capstan having teeth and a brake cable connected between the brake release spring and a brake handle and having out-of-balance springs connected to a first side and a second side of the stop, providing a housing for the brake, the housing having an opening with a center portion having out-of-balance shoulders adjacent the center portion, wherein the stop for the brake extends through the opening in the housing, and wherein when the weight of the load on the work surface is within the predetermined range, the out-of-balance springs exert a force on the stop to hold the stop in a balanced position so that the stop is positioned in the center portion of the opening in the housing, and squeezing the brake handle to disengage the brake so that the brake cable exerts a force on the brake release spring in a direction away from the braking capstan to move the stop away from the braking capstan so that the stop moves in the center portion of the opening in the housing and out of contact with braking capstan, wherein when the weight of the load on the work surface is outside of the predetermined range, the force of the out-of-balance springs is overcome so that the stop is moved to an out-of-balance position so that when the brake release spring moves the stop away from the braking capstan, the stop contacts one of the out-of-balance shoulders adjacent the center portion of the opening of the housing to prevent the stop from being moved out of contact with the braking capstan so that the stop remains engaged between the teeth of the braking capstan.

The substance and advantages of the present invention will become increasingly apparent by reference to the following drawings and the description.

DETAILED DESCRIPTION OF THE INVENTION

Figure 1:
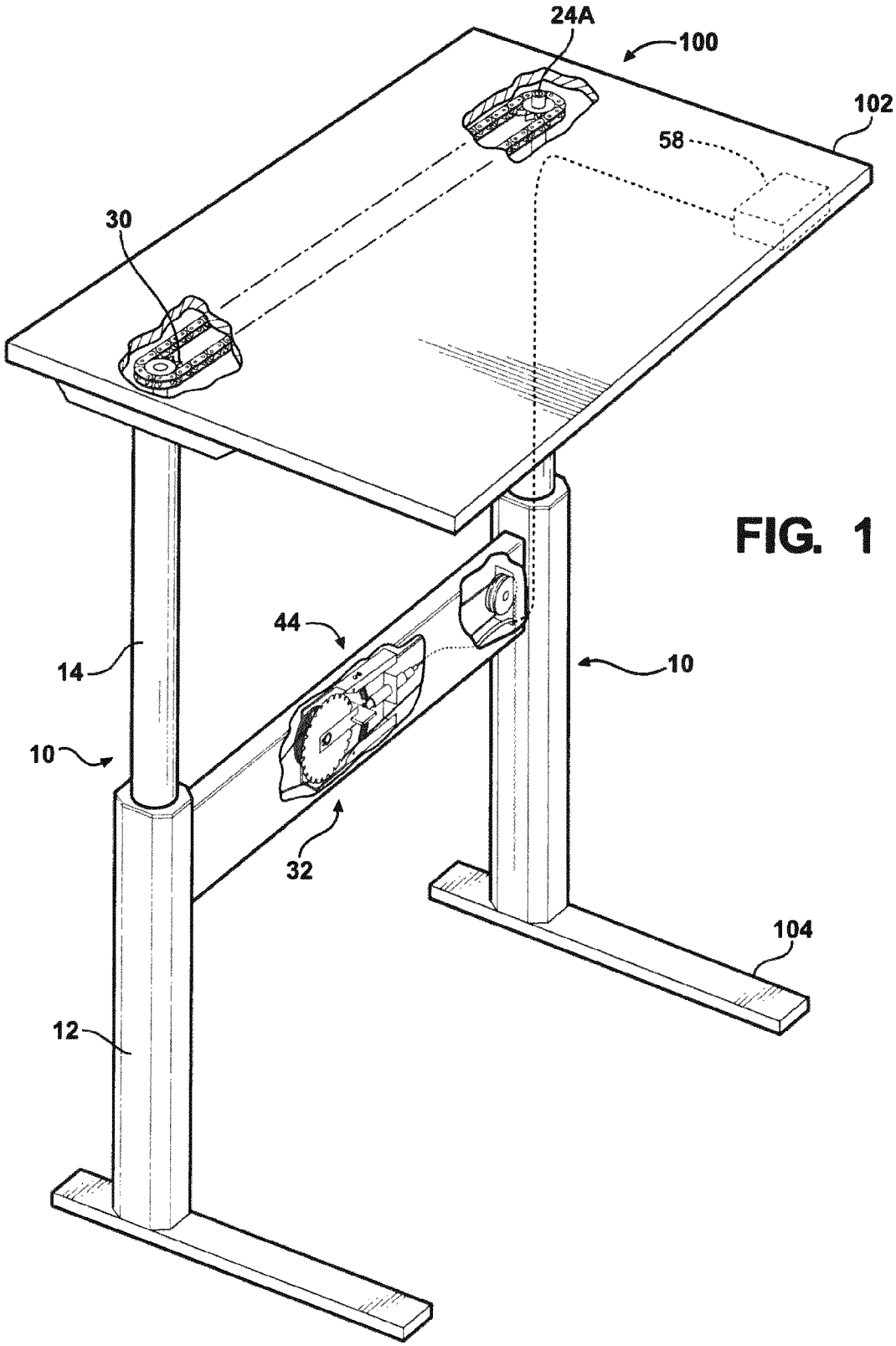
FIG. 1 is a perspective view of the workstation 100 having a cut out showing the brake 44.
Figure 6:
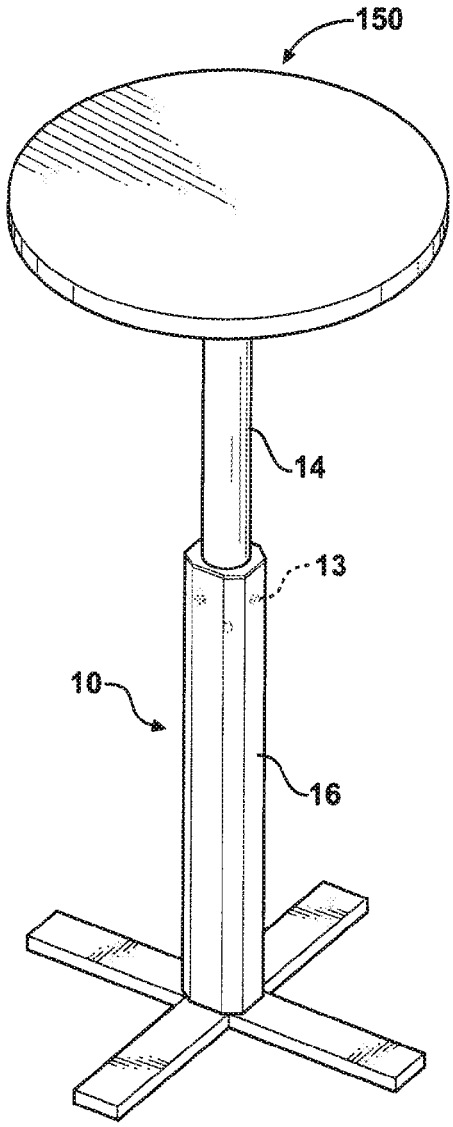
FIG. 6 is a perspective view of another embodiment of the workstation 150 having a single counterbalance apparatus 10.
Figure 7:
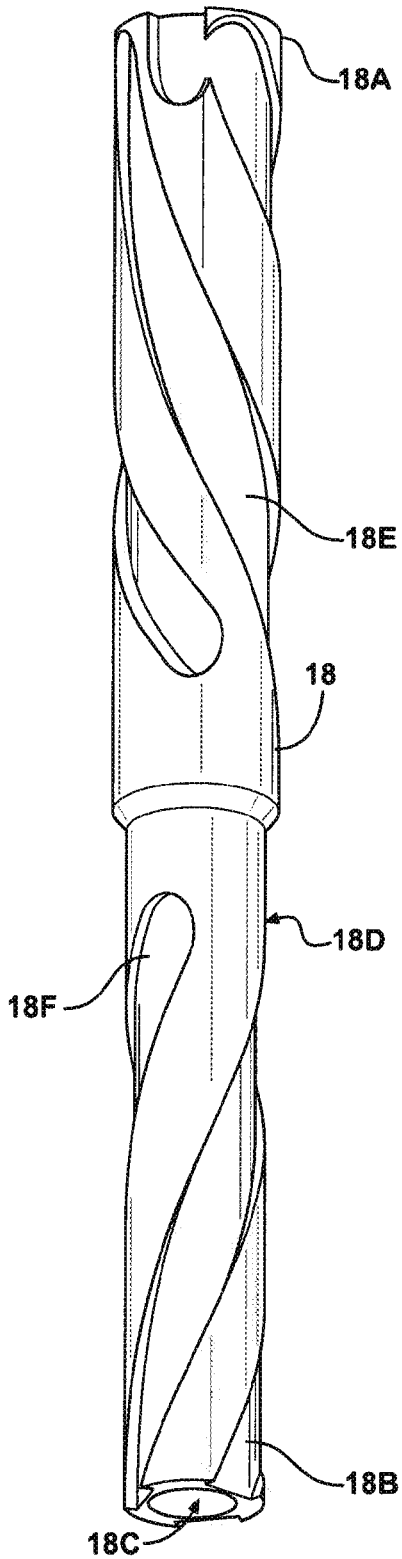
FIG. 7 is a front view of the grooved member 18.
Figure 8:
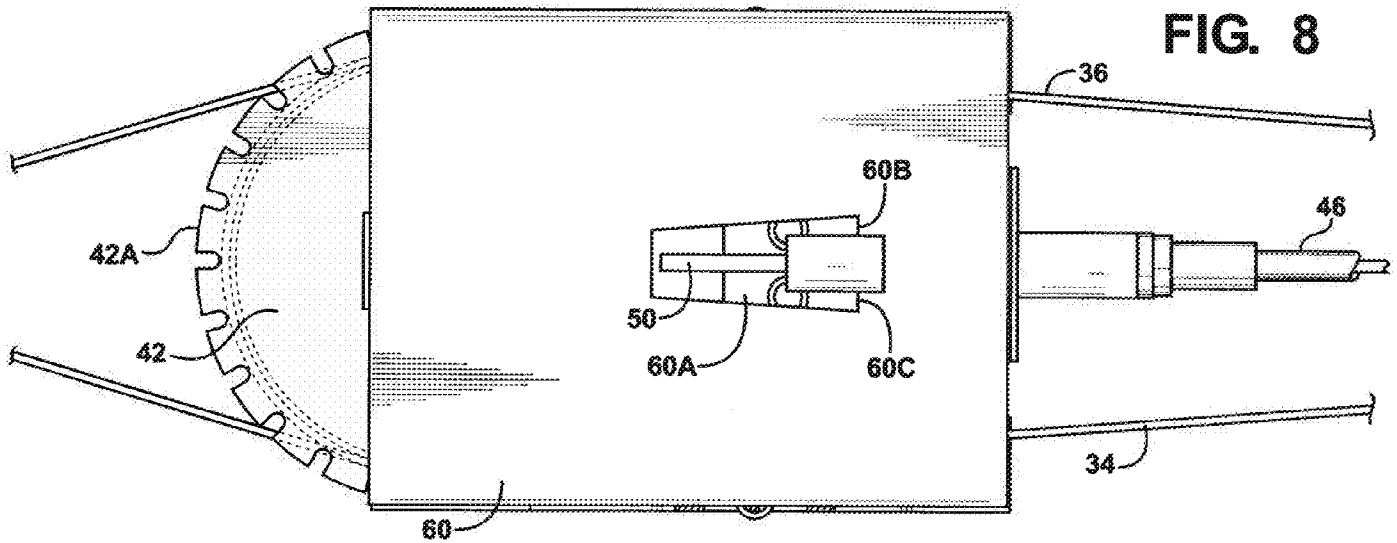
FIG. 8 is a partial view of the brake 44 showing the opening 60A in the housing 60.

FIGS. 1 to 6 show the counterbalance apparatus 10 of the present invention. In one (1) embodiment, the counterbalance apparatus 10 is for use in a workstation 100 to raise and lower a work surface 102 of a workstation 100. The counterbalance apparatus 10 enables a user to easily raise and lower the work surface 102 of a workstation 100 by applying a small upward or downward force on the work surface 102 even when there is a load on the work surface 102. The counterbalance apparatus 10 is positioned between the work surface 102 and the base 104 of the workstation 100. In one (1) embodiment, the counterbalance apparatus 10 is housed in the leg of the workstation 100. In one (1) embodiment, the workstation 100 includes a pair of counterbalance apparatus 10 which work together to raise or lower the work surface 102 (FIG. 1). In another embodiment, the workstation 150 has a single counterbalance apparatus 10 such as in a pedestal table (FIG. 6). However, it is understood that the workstation 100 can have any number of counterbalance apparatus 10. The counterbalance apparatus 10 is essentially the same regardless of the number of counterbalance apparatus 10 used in the workstation 100. However, the counterbalance apparatus 10 have slight variations depending on the number of counterbalance apparatus 10 used for each workstation 100. It is understood that a decorative housing can be used to conceal or change the appearance of the counterbalance apparatus 10. In one (1) embodiment, the outward appearance of the counterbalance apparatus 10 is the same for a workstation 150 having a single leg and a single counterbalance apparatus 10 as for a workstation 100 having multiple legs and multiple counterbalance apparatus 10. In one (I) embodiment, a family of workstations 100 uses a variety of mechanisms to raise and lower the work surface 102. In one (1) embodiment, the mechanisms include a crank mechanism, an electrical mechanism, and a counterbalance mechanism. In this embodiment, the outward appearance of the leg of the workstation 100 is essentially identical regardless of the raising and lowering mechanism used in the legs.

The counterbalance apparatus 10 includes an outer column 12, an inner column 14, a base member 16, a grooved member 18, and a force mechanism 20. In one (1) embodiment, the counterbalance apparatus 10 also includes an adjustment rod 24. The outer column 12 has a first end 12A and a second end 12B. The second end 12B of the outer column 12 is adjacent the base 104 of the workstation 100. In one (1) embodiment, the outer column 12 is secured to the base 104. In one (1)

embodiment, the outer column 12 is not secured to the base 104. The outer column 12 extends upward from the base 104 toward the work surface 102. In one (1) embodiment, the outer column 12 extends upward essentially perpendicular to the base 104. The outer column 12 is hollow and has an inner passageway 12C extending between the ends 12A and 12B. The first end 12A of the outer column 12 is open. The outward shape of the outer column 12 and the shape of the inner passageway 12C can vary. Guide rollers 12D are mounted in the inner passageway 12C of the outer column 12 adjacent the first end 12A of the outer column 12. The guide rollers 12D assist the movement of the inner column 14 in the outer column 12. In one (1) embodiment, the guide rollers 12D ensure that the inner column 14 is essentially centered in the outer column 12. In one (1) embodiment, the outer column 12 has opposed walls and the guide rollers 12D are mounted on the opposed walls. In one (1) embodiment, the guide rollers 12D have a curved surface to allow for better contact with the outer surface of the inner column 14. The guide rollers 12D also prevent the inner column 14 from cantilevering in the outer column 12 when a load is placed at the front edge of the work surface 102.

Figure 2:
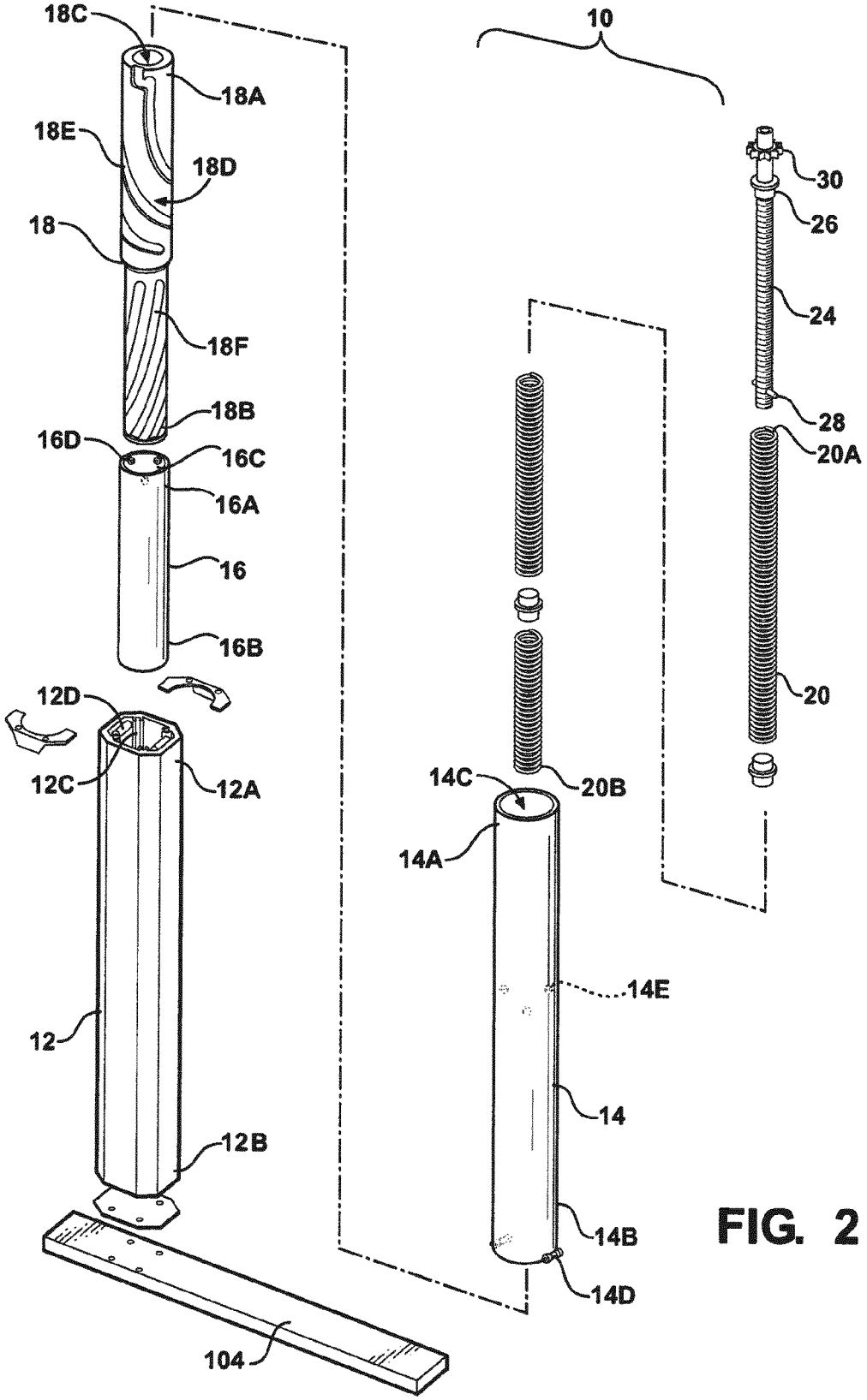
FIG. 2 is an exploded view of the counterbalance apparatus 10.

The inner column 14 has a first end 14A and a second end 14B with an inner bore 14C extending between the ends 14A and 14B. The inner column 14 is mounted so that the second end 14B extends into the inner passageway 12C of the outer column 12 adjacent the first end 12A of the outer column 12. The inner column 14 is telescopically and slideably mounted in the outer column 12. In one (1) embodiment, the inner column 14 and the outer column 12 are coaxial and form the longitudinal axis A-A of the counterbalance apparatus 10 (FIG. 2). The second end 14B of the inner column 14 has guide rollers 14D mounted on the outer surface which contact the inner surface of the outer column 12 as the inner column 14 moves up and down within inner passageway 12C of the outer column 12. The inner column 14 extends upward beyond the outer column 12 so that the first end 14A of the inner column 14 is adjacent the work surface 102 of the workstation 100. In one (1) embodiment, the first end 14A of the inner column 14 is mounted to a bracket 106 and the work surface 102 is mounted on the opposite side of the bracket 106. In one (1) embodiment, where the workstation 100 has a single counterbalance apparatus 10, the inner column 14 has anti-torque rollers 13 mounted on the outer surface adjacent the guide rollers 14D (FIG. 6). The anti-torque rollers 13 prevent the inner column 14 from rotating in the outer column 12 as the workstation 100 is raised and lowered (FIG. 6). In one (1) embodiment, the outer column 12 and inner column 14 provide the visible portion of the leg of the workstation 100.

First rollers 14E are mounted in the inner bore 14C of the inner column 14 spaced apart from the first and second ends 14A and 14B of the inner column 14. In one (1) embodiment, the inner bore 14C of the inner column 14 is cylindrical. In one (1) embodiment, there are three (3) first rollers 14E which are evenly spaced apart around the inner circumference of the inner bore 14C of the inner column 14. In one (1) embodiment, the first rollers 14E are radially spaced apart approximately 120°. In one (1) embodiment, the first rollers 14E are roller bearings having the shape of wheels. The first rollers 14E have an inner and outer portion with ball bearings therebetween. The first rollers 14E are mounted such that the axis of rotation of the first roller 14E is perpendicular to the longitudinal axis A-A of the counterbalance apparatus 10. The first rollers 14E have holes (not shown) in the center through extending a mounting pin providing the axis of rotation for the first rollers 14E. The mounting pins extend inward from the wall of the inner column 14 into the inner bore 14C of the inner column 14. The center portion of the first rollers 14E are mounted on the center portion of the mounting pin so that the inner portion remains stationary while the outer portion rolls within the first grooves 18E. The first rollers 14E could also be bronze bushings or plastic bushings.

The base member 16 has opposed first and second ends 16A and 16B with an inner bore 16C extending therebetween. The base member 16 is mounted so that the second end 16B of the base member 16 is adjacent the base 104 of the workstation 100. In one (1) embodiment, the base member 16 extends upward from the base 104 essentially perpendicular to the base 104. In one (1) embodiment, the base member 16 is coaxial with the outer column 12. In one (1) embodiment, the second end 16B of the base member 16 is mounted to the base 104 of the workstation 100.

Second rollers 16D are provided adjacent the first end 16A of the base member 16 in the inner bore 16C of the base member 16. In one (1) embodiment, the inner bore 16C of the base member 16 is cylindrical. In one (1) embodiment, there are three (3) second rollers 16D spaced evenly apart around the inner circumference of the inner surface of the base member 16. In one (1) embodiment, the second rollers 16D are radially spaced apart approximately 120°. In one (1) embodiment, the second rollers 16D are similar to the first rollers 14E of the inner column 14. In one (1) embodiment, the base member 16 has a cylindrical shape. In one (1) embodiment, the size of the base member 16 is less than the size of the inner bore 14C of the inner column 14 so that the base member 16 can extend into the inner bore 14C of the inner column 14.

The grooved member 18 has opposed first and second ends 18A and 18B with a sidewall 18D and an inner bore 18C extending between the ends 18A and 18B. In one (1) embodiment, the grooved member 18 has an essentially cylindrical shape. The outer surface of the sidewall 18D of the grooved member 18 has first grooves 18E adjacent the first end 18A of the grooved member 18 and second grooves 18F adjacent the second end 18B of the grooved member 18. The exact shape or slope of the first and second grooves 18E and 18F can vary depending on the use of the counterbalance apparatus 10 including the amount of load to be raised and lowered and the amount of travel of the work surface 102. The grooved member 18 is slideably and telescopically mounted in the base member 16 so that the second end 18B of the grooved member 18 extends into the inner bore 16C of the base member 16 at the first end 16A of the base member 16. The second grooves 18F adjacent the second end 18B of the grooved member 18 engage the second rollers 16D in the inner bore 16C of the base member 16. In one (1) embodiment, the grooved member 18 has three (3) second grooves 18F which engage the three (3) rollers in the inner bore 16C of the base member 16. In one (1) embodiment, the three (3) second grooves 18F are essentially identical and are spaced approximately 120° apart around the sidewall of the grooved member 18. The second grooves 18F are orientated in a spiral configuration at a uniform angle around the outer circumference of the grooved member 18 such that the slope of the curve of the second grooves 18F is linear. In one (1) embodiment, the diameter of the second rollers 16D is essentially the same as the width of the second grooves 18F so that there is essentially very little side to side or extraneous movement of the second rollers 16D in the second grooves 18F. In one (1) embodiment, the second rollers 16D have a diameter of approximately 0.6875 inches (17.4625 mm) and the second grooves 18F have a width of approximately 0.713 inches (18.11 mm). In one (1) embodiment, the grooved member 18 has a length between the ends of approximately 21.75 inches (552.45 mm) and the second grooves 18F extend along a length of approximately 9.981 inches (253.52 mm) of the grooved member 18. In one (1) embodiment, the distance traveled by the second rollers 16D in the second grooves 18F is approximately 8.821 inches (224.05 mm) so that the grooved member 18 extends into the base member 16 approximately 8.821 inches (224.05 mm) when the counterbalance apparatus 10 is in the unextended position.

The grooved member 18 extends upward from the base member 16 so that the first end 18A of the grooved member 18 extends into the inner bore 14C of the inner column 14 adjacent the second end 14B of the inner column 14. The first end 18A of the grooved member 18 is slideably and telescopically mounted in the inner bore 14C of the inner column 14. In one (1) embodiment, the grooved member 18 has three (3) first grooves 18E adjacent the first end 18A which engage the three (3) first rollers 14E in the inner bore 14C of the inner column 14. The first grooves 18E are compound grooves. In one (1) embodiment, the first grooves 18E extend around the sidewall 18D of the grooved member 18 in an essentially spiral orientation. The first grooves 18E do not have a uniform curve. The exact angle and spacing of the first grooves 18E is dependent upon the spring 20. The diameter of the first rollers 14E is essentially the same as the width of the first grooves 18E such that there is no extraneous movement of the first rollers 14E in the first grooves 18E. In one (1) embodiment, the first rollers 14E have a diameter of approximately 0.875 inches (22.225 mm) and the first grooves 18E have a width of approximately 0.900 inches (22.86 mm). In one (1) embodiment, the first end of the first grooves 18E adjacent the first end 18A of the grooved member 18 have an enlarged opening so that during construction of the counterbalance apparatus 10, the first end 18A of the grooved member 18 is inserted into the second end 14B of the inner column 14 until the first rollers 14E enter the enlarged open first end of the first grooves 18E. Once the first rollers 14E are in the enlarged, open first end of the first grooves 18E, the grooved member 18 is rotated slightly to move the first rollers 14E into the first grooves 18E and to lock the grooved member 18 in place. In one (1) embodiment, the three (3) first grooves 18E are essentially identical and are spaced approximately 120° apart around the sidewall 18D of the grooved member 18. In one (1) embodiment, the first grooves 18E extend along a length of the grooved member 18 essentially 9.470 inches (240.538 mm). In one (1) embodiment, the distance traveled by the first rollers 14E in the first grooves 18E is approximately 8.179 inches (207.75 mm) so that the grooved member 18 travels an additional length of 8.179 inches (207.75 mm) in the inner column 14 from the lowered, unextended position to the raised, fully extended position. In one (1) embodiment, the movement of the first rollers 14E in the first grooves 18E and the movement of the second rollers 16D in the second grooves 18F causes the grooved member 18 to rotate in the inner column 14 and the base member 16 as the vertical height of the work surface 102 is adjusted.

The force mechanism 20 is used to provide resistance to allow for raising and lowering the work surface 102 using a substantially constant force. In one (1) embodiment, the force mechanism 20 is a spring. In one (1) embodiment, the spring 20 is constructed of three (3) springs connected together by spring couplers. The springs are connected end-to-end which allows the springs to act in unison as a single spring. It is understood that the term spring 20 can refer to a single spring or multiple springs connected together and acting together. In one (1) embodiment, the spring 20 is a coil spring. However, it is understood that a single spring, a plurality of springs or any other means of providing resistance can be used. In one (1) embodiment, in essentially the uncompressed position, the spring 20 extends from the second end 18B of the grooved member 18 through the inner bore 18C of the grooved member 18 to the work surface 102 of the workstation 100. In one (1) embodiment, the second end 18B of the grooved member 18 is closed to prevent the spring 20 from extending below the second end 18B of the grooved member 18. The spring 20 is positioned so that the second end 20B of the spring 20 is adjacent the second end 18B of the grooved member 18 and the first end 20A of the spring 20 is adjacent the underneath surface of the work surface 102. The spring 20 is selected based upon the range of weight of the load on the work surface 102 which is also used to determine the adjusted pre-load force applied to the counterbalance apparatus 10. In one (1) embodiment, the spring 20 is non-constant and changes its force output at a substantially constant, compound rate and is matched and in unison with the first grooves 18E.

Figure 3:
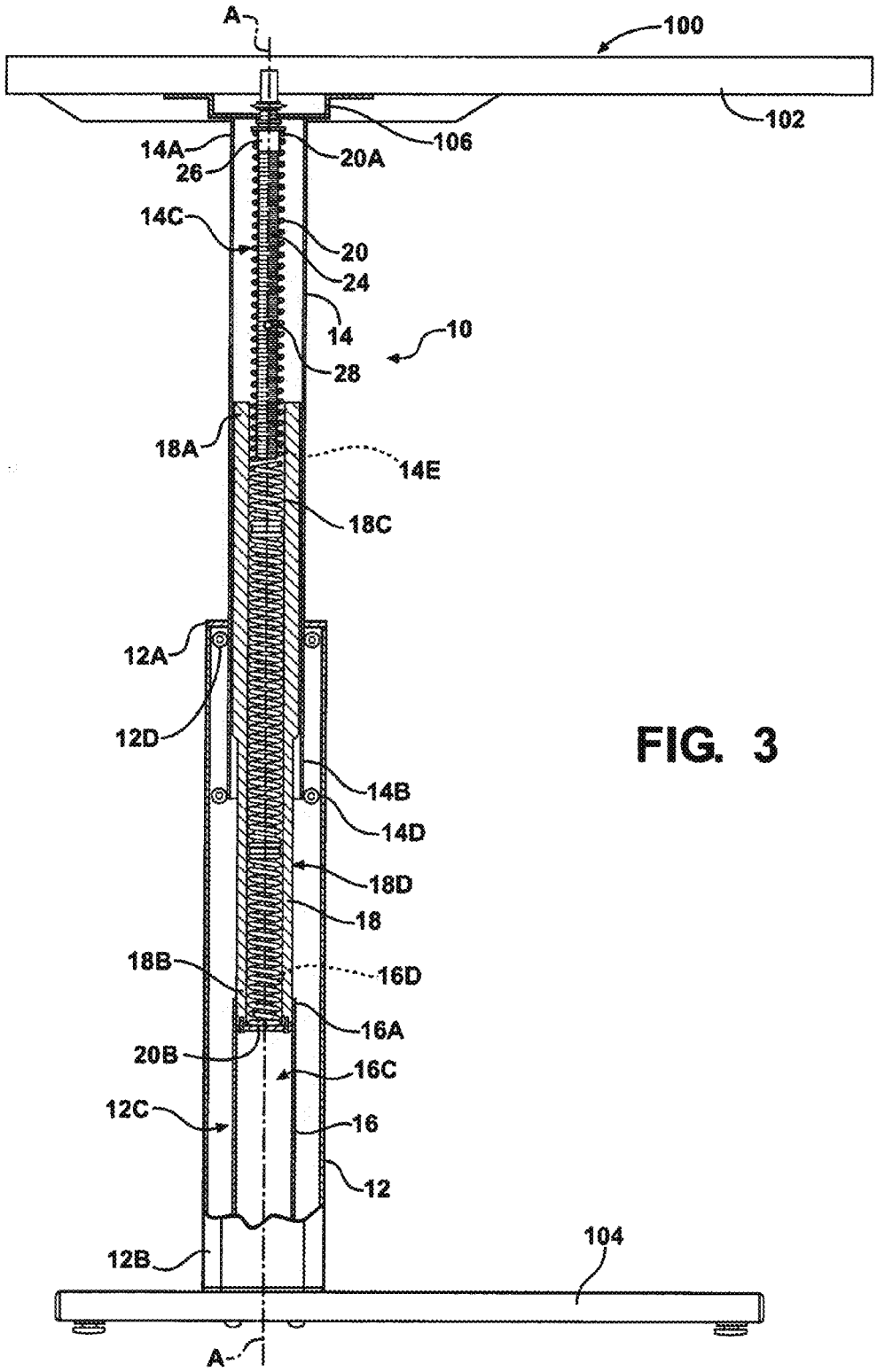
FIG. 3 is a side view of a workstation 100 having a counterbalance apparatus 10.
Figure 9:
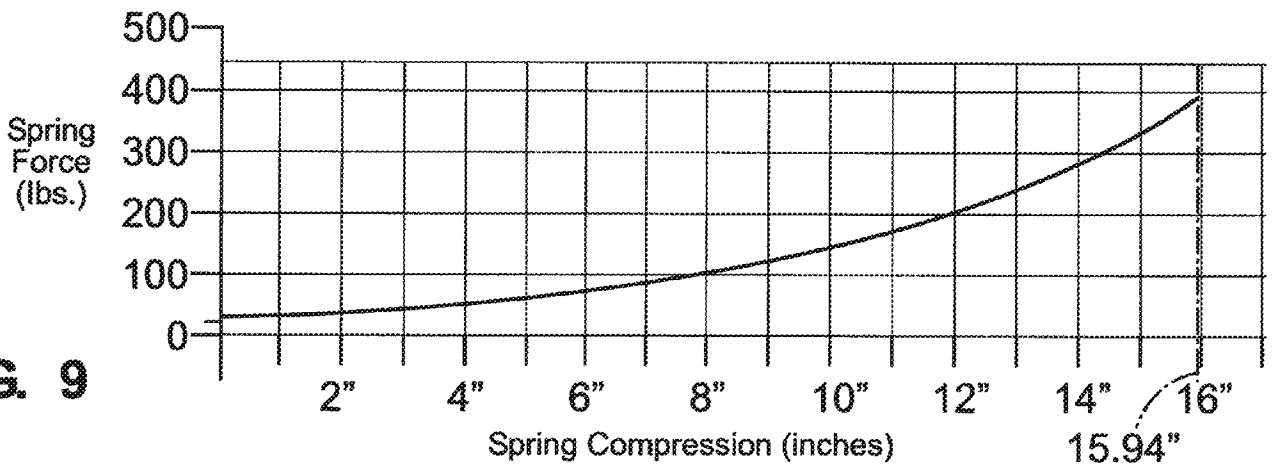
FIG. 9 is a graph showing the non-linear force curve of the spring 20 as the work surface 102 is moved and the spring 20 is compressed for a pre-loaded range of approximately 30 lbs to 105 lbs.
Figure 10:
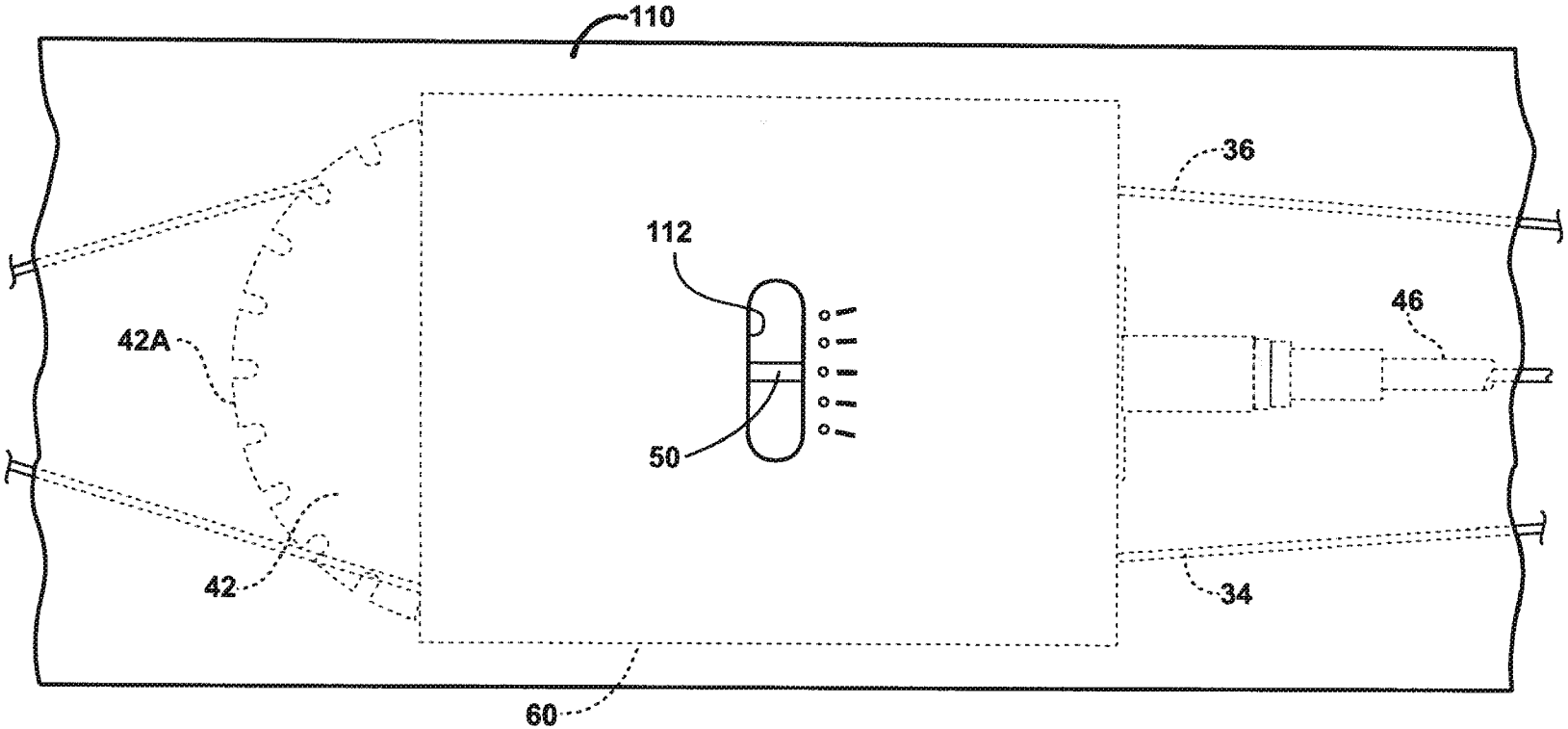
FIG. 10 is a partial front view of the anti-racking system 32 and the brake 44 showing the cover plate 110 and the window 112.

In one (1) embodiment, the spring curve is shown in FIG. 9. The adjusted pre-load force is the initial pre-load force ($F_0$) which is necessary to hold up the work surface 102 plus the force which is necessary to compensate for the load on the work surface 102. Changing the range of adjusted pre-load force could require changing the spring 20 and the curve of the first and second grooves 18E and 18F. In one (1) embodiment, the spring 20 is defined by the equation:

$$F=F_0\times e^{-KY}$$

where F is the force exerted by the spring 20 and $F_0$ is the initial pre-load force on the spring 20 which holds the work surface 102 up with no load on the work surface 102. In one (1) embodiment, the initial pre-load force ($F_0$) is equal to the amount of force pushing down on the counterbalance apparatus 10 by the work surface 102. In one (1) embodiment, in the initial position with the counterbalance apparatus 10 fully extended, the spring 20 is not fully extended. In one (1) embodiment, the spring 20 is compressed to provide the initial pre-load force ($F_0$). K is the constant defining the compound rate of change of the spring rate and Y is the displacement or the compression distance of the spring 20 along the longitudinal axis A-A of the counterbalance apparatus 10. In one (1) embodiment, the displacement of the spring 20 is calculated from a starting point of zero (0) which represents the length of the spring 20 when the first rollers 14E are at the top or first end of the first grooves 18E adjacent the first end 18A of the grooved member 18 and the second rollers 16D are at the bottom or first end of the second grooves 18F adjacent the second end 18B of the grooved member 18 so that the counterbalance apparatus 10 is in the fully extended position (FIG. 3). In one (1) embodiment, Y is always a negative number. In one (1) embodiment, there is a constant relationship between the force exerted by the spring 20 (F) and the instantaneous spring constant IF/ΔY such that F/(IF/ΔY) remains constant throughout the compression of the spring 20. Once the spring 20 is selected, the slope of the first and second grooves 18E and 18F is determined using the equation:

$$X = \frac{\left(Y - \frac{1}{K}[1 - e^{-KT}]\right)}{M}$$

where X is the displacement of the first rollers 14E along the first grooves 18E and is an angular value due to the curvature of the first grooves 18E. M is the slope of the line representative of the second grooves 18F. In addition, the slope of the first grooves 18E can be adjusted to compensate for the addition of the friction force caused by the first rollers 14E moving along the first grooves 18E. The second grooves 18F are linear and share the force of the spring 20 with the first grooves 18E and compensate for the adjusted pre-load force or constant portion of the force applied to the counterbalance apparatus 10. The second grooves 18F also allow the work surface 102 to travel an additional distance beyond the distance resulting from compression of the spring 20 and travel of the first grooves 18E. In one (1) embodiment, the second grooves 18F provide an additional distance of travel of the work surface 102 of 8.821 inches (224.05 mm). The angle of the first grooves 18E varies to compensate for the change in spring rate of the spring 20. In one (1) embodiment, the total compression of the spring 20 is 15.939 inches (404.8506 mm) which is the combination of the pre-load compression and the actual compression or travel of the spring 20 as the counterbalance apparatus 10 is extended and compressed. The axial length of the first grooves 18E and the pre-load adjustment represents the total compression of the spring 20. The axial length of the first grooves 18E and the axial length of the second grooves 18F provide for the total amount of distance traveled by the work surface 102. The first rollers 14E move along the first grooves 18E at the same time as the second rollers 16D move along the second grooves 18F. In one (1) embodiment, the work surface 102 travels a total distance of approximately 17 inches (431.8 mm). However, it is understood that the counterbalance apparatus 10 can be modified to adjust the travel distance of the work surface 102. The choice of spring 20 and the slope of the first and second grooves 18E and 18F allows for a substantially constant force acting on the work surface 102 by the counterbalance apparatus 10 throughout the entire movement of the work surface 102 regardless of the specific adjusted pre-load force chosen within the range. Once the spring 20 and the first and second grooves 18E and 18F are selected, the counterbalance apparatus 10 is assembled and mounted as the leg of the workstation 100.

In one (1) embodiment, the spring 20 has a inner bore and the adjustment rod 24 is positioned in the inner bore. In one (1) embodiment, the first end of the adjustment rod 24 is connected to the bracket 106 of the workstation 100. In one (1) embodiment, the adjustment rod 24 is only secured at the first end. The adjustment rod 24 is threaded and has an adjustment nut 26 positioned at the first end 20A of the spring 20. The adjustment rod 24 and adjustment nut 26 allow for preloading the spring 20. As the adjustment rod 24 is rotated, the adjustment nut 26 moves up and down the threaded adjustment rod 24 which changes the amount of the initial compression of the spring 20 and thus the amount of initial force exerted by the spring 20 on the work surface 102 when the work surface 102 is in the fully raised position. The first end of the adjustment rod 24 extends upward beyond the first end 20A of the spring 20. The threaded adjustment rod 24 extends through an opening (not shown) in the work surface 102. When the counterbalance apparatus 10 is correctly mounted on the workstation 100, the first end of the threaded adjustment rod 24 is slightly below the top surface of the work surface 102. The first end of the adjustment rod 24 has an adjustment head 24A which allows a user to easily rotate the adjustment rod 24 to adjust the amount of pre-load on the spring 20 using a crank handle (not shown). The opening in the work surface 102 is slightly larger than the adjustment head 24A of the threaded adjustment rod 24 such that the crank handle can be mounted on the adjustment head 24A of the threaded adjustment rod 24 to rotate the threaded adjustment rod 24 to allow adjustment of the pre-load force on the spring 20. The crank handle is attached onto the adjustment head 24A and is rotated until the initial tension or adjusted pre-load force on the spring 20 is correct for the weight of the work surface 102 and any items or load on the work surface 102. Once the counterbalance apparatus 10 is properly installed and the pre-load force is correctly set, the forces exerted on the work surface 102 are in equilibrium which allows the work surface 102 to be easily moved up or down in a vertical direction. A stop 28 is provided on the spring 20 or on the adjustment rod 24 to limit the movement of the adjustment nut 26 and thus limit the amount of pre-load or compression applied to the spring 20. In one (1) embodiment, the pre-load on the spring 20 can be adjusted for a load between 30 lbs. and 105 lbs. for each counterbalance apparatus 10. For a workstation 100 having two (2) counterbalance apparatus 10, the pre-load allows for a range of weight for the load balance approximately 0 lbs. to approximately 170 lbs. The weight of the metal components and the work surface 102 are subtracted from the actual functional spring force output of 210 lbs. It is understood that the pre-load range can be varied depending on the use of the counterbalance apparatus 10.

In the embodiment having two (2) counterbalance apparatus 10, one (1) in each leg, the first end the threaded adjustment rod 24 below the top surface of the work surface 102 is provided with an adjustment sprocket 30. The adjustment sprocket 30 of the first counterbalance apparatus 10 is attached by a chain or belt to an identical sprocket 30 located on the adjustment rod 24 of the second counterbalance apparatus 10 in the opposite leg (FIG. 1). The connection of the threaded adjustment rods 24 of the counterbalance apparatus 10 ensures that the pre-load force on the spring 20 of each counterbalance apparatus 10 is essentially the same. In one (1) embodiment, the chain or belt connecting the two (2) counterbalance apparatus 10 is protected and concealed by a housing (not shown).

Figure 4:
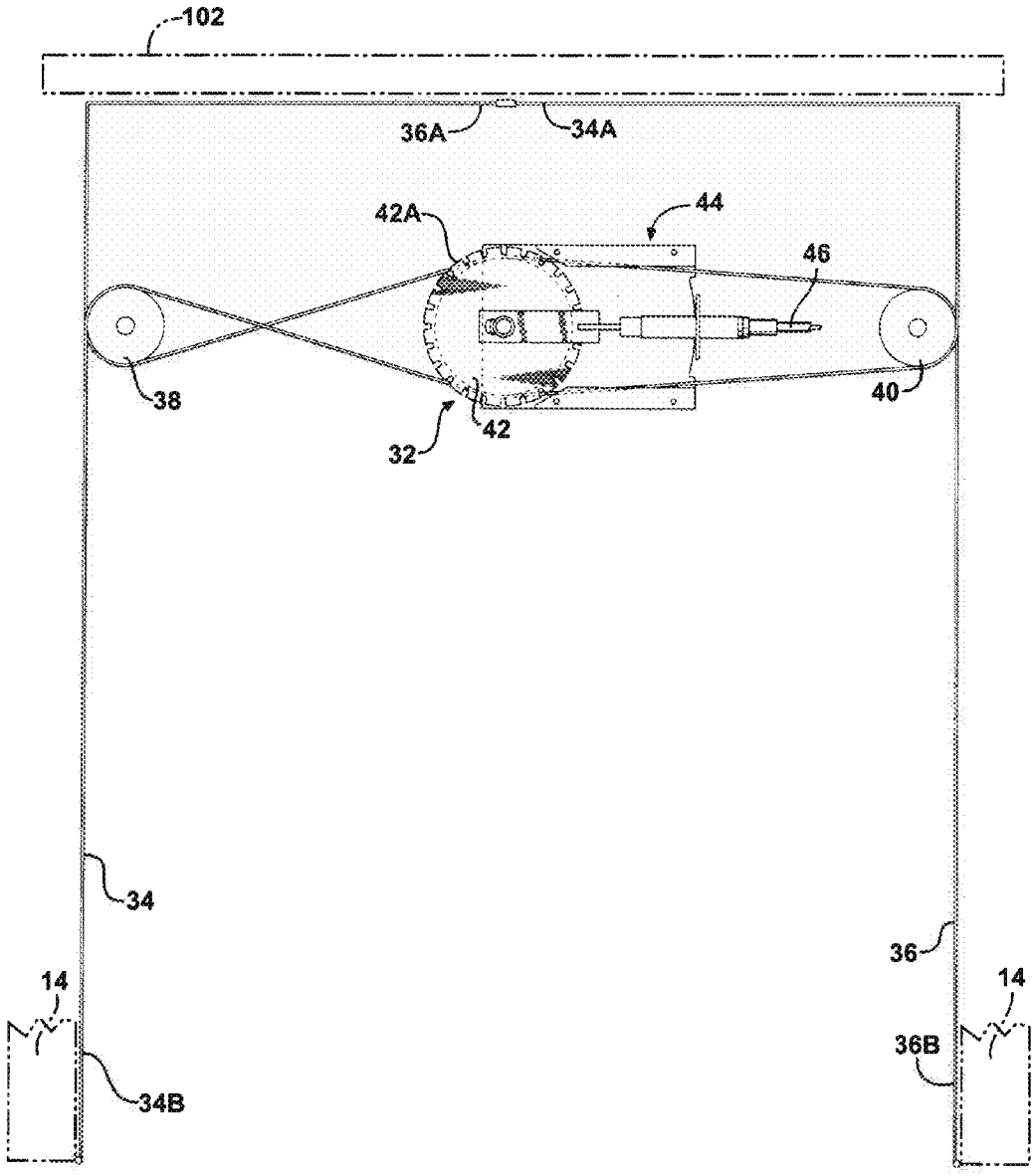
FIG. 4 is a schematic view of the anti-racking system 32.
Figure 5:
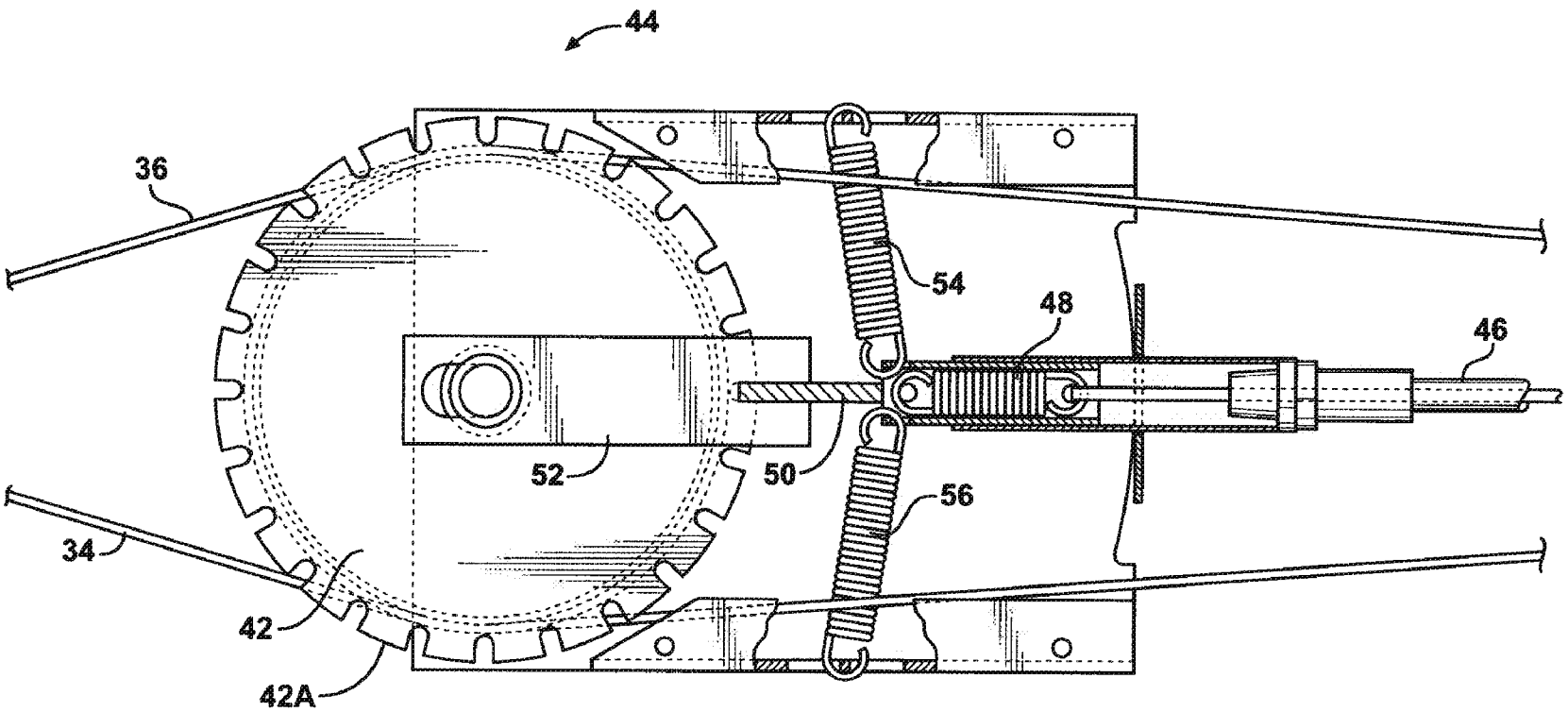
FIG. 5 is a partial view of the anti-racking system 32 showing the braking capstan 42 and brake 44.

In one (1) embodiment, where the workstation 100 has a pair of counterbalance apparatus 10, the counterbalance apparatus 10 are connected by an anti-racking system 32 (FIG. 1). The anti-racking system 32 ensures that the counterbalance apparatus 10 move together at the same rate so that the work surface 102 remains level as it is raised and lowered. In one (1) embodiment, the anti-racking system 32 includes a first and second cable 34 and 36, a first and second pulley 38 and 40, and a braking capstan 42. The second end 34B of the first cable 34 is connected to the second end 14B of the inner column 14 of the first counterbalance apparatus 10 (FIG. 4). The first cable 34 extends over the first pulley 38 adjacent the first counterbalance apparatus 10, under and wraps around and along the braking capstan 42 to the second pulley 40 adjacent the second counterbalance apparatus 10. The first cable 34 then extends under and around the second pulley 40 and up the second counterbalance apparatus 10 and along the underneath side of the work surface 102 of the workstation 100. In one (1) embodiment, the first cable 34 wraps around the braking capstan 42 twice. The second end 36B of the second cable 36 is connected to the second end 14B of the inner column 14 of the second counterbalance apparatus 10. The second cable 36 extends up the second counterbalance apparatus 10 and over the second pulley 40 adjacent the second counterbalance apparatus 10 and then over and wraps around and along the braking capstan 42 and under and around the first pulley 38 adjacent the first counterbalance apparatus 10. The second cable 36 then extends up along the first counterbalance apparatus 10 to the work surface 102 and along the work surface 102 to the first cable 34. In one (1) embodiment, the second cable 36 wraps around the braking capstan 42 twice. The first ends 34A and 36A of the first and second cables 34 and 36 are connected together. In one (1)

embodiment, the first ends 34A and 36A of the first and second cables 34 and 36 are connected together by a spring and a turnbuckle system which enables the first and second cables 34 and 36 to be placed in tension to help the work surface 102 move up and down smoothly. In one (1) embodiment, the first and second cables 34 and 36 have a tension of 50 lbs. The tension in the cables 34 and 36 also prevents the work surface 102 from canting or tilting when an out-of-balance load is placed on the work surface 102. It is understood that an anti-racking system similar to the anti-racking system described herein can be used for workstations 100 having more than two (2) legs.

A brake 44 is provided for workstation 100 which uses the braking capstan 42 of the anti-racking system 32 to enable a user to lock the work surface 102 at a specific height. The brake 44 prevents the braking capstan 42 from rotating which prevents the cables 34 and 36 of the anti-racking system 32 from moving which prevents the counterbalance apparatus 10 from extending or compressing.

The brake 44 includes the braking capstan 42 of the anti-racking system 32, a brake cable 46, a brake release spring 48, a stop 50, guides 52 and a pair of out-of-balance springs 54 and 56. The braking capstan 42 is mounted on an axle parallel to the ground surface. The perimeter of the braking capstan 42 has teeth 42A. The stop 50 is positioned adjacent the perimeter of the braking capstan 42. The stop 50 is connected by the brake cable 46 to a brake handle 58. The brake release spring 48 is provided between the brake cable 46 and the stop 50. The out-of-balance springs 54 and 58 act to move the stop 50 into the locked or braked position between the teeth 42A of the braking capstan 42 when the brake handle 58 is released. The guides 52 are slideably connected to the axle of the braking capstan 42 and are attached to each end of the stop 50 on each side of the braking capstan 42. The guides 52 ensure that the stop 50 moves straight and into the spaces between the teeth 42A of the braking capstan 42. The brake 44 has a housing 60 which covers the stop 50, the out-of-balance springs 54 and 56 and a portion of the braking capstan 42. In one (1) embodiment, the housing 60 covers each side of the brake 44. The housing 60 has an opening 60A adjacent to the stop 50. In one (1) embodiment, the opening 60A has a center portion with upper and lower shoulders 60B and 60C adjacent the center portion. The stop 50 extends through the opening 60A in the housing 60. The brake 44 uses the stop 50 as an indicator to enable a user to determine if the load on the work surface 102 is out-of-balance. The load on the work surface 102 is out-of-balance when the weight of the load is not within the pre-determined range. The pre-load setting on the spring 20 enables a user to adjust the range for the balanced load and thus set the out-of balance upper and lower limits. The load on the work surface 102 can be out-of-balance if too much load is placed on the work surface 102 or if not enough load is placed on the work surface 102. The out-of-balance springs 54 and 56 are attached to the top side and bottom side of the stop 50. The out-of-balance springs 54 and 56 prevent the brake 44 from disengaging if the load on the work surface 102 is out-of-balance. The out-of-balance springs 54 and 56 act to keep the stop 50 in the center balanced position. The out-of-balance springs 54 and 56 are positioned so that any out-of-balance load on the work surface 102 will overcome the force of the springs 54 and 56 so that the stop 50 is moved to the out-of-balance position. Too much weight on the work surface 102 overcomes the force of the top out-of-balance spring 54 and moves the stop 50 down to an out-of-balance position below the center balanced position. Not enough weight on the work surface 102 overcomes the force of the bottom out-of-balance spring 56 and moves the stop 50 to an out-of-balance position above the center balanced position. When the weight of the load on the work surface 102 is outside of the predetermined range for the weight for the load, the work surface 102 is raised or lowered slightly which moves the cables 34 and 36 of the anti-racking system 32 which rotates the braking capstan 42. The stop 50 of the brake 44 prevents the braking capstan 42 from rotating completely and prevents the work surface 102 from being raised or lowered. However, the rotation of the braking capstan 42 moves the stop 50 of the brake 44 either upward or downward slightly which moves the stop 50 into the out-of-balance position. In one (1) embodiment, where the brake 44 is mounted in the cross member of the workstation 100, the brake 44 and the anti-racking system 32 are enclosed in a housing having a cover plate 110. The cover plate 110 has a window 112 which allows for viewing the stop 50. The cover plate 110 has marks adjacent the window 112 which indicate to the user whether or not the work surface 102 is out-of-balance based on the position of the stop 50. If the work surface 102 is out-of-balance, the user can adjust the pre-load on the counterbalance apparatus 10, or add or remove weight on the work surface 102 to balance the work surface 102. When the stop 50 is below the center position on the cover plate 110, there is too much load on the work surface 102. The user can increase the pre-load on the counterbalance apparatus 10 or remove weight from the work surface 102 to balance the load on the work surface 102 and move the stop 50 to the center, balanced position. When the stop 50 is above the center, balanced position as shown by the marks on the cover plate 110, there is not enough load on the work surface 102. The user can decrease the pre-load on the counterbalance apparatus 10 or add weight to the work surface 102 to balance the load on the work surface 102 and move the stop 50 to the center, balanced position. Once the load on the work surface 102 is balanced, the brake 44 can be disengaged.

In the initial, at rest, default position, the brake 44 is engaged so that the work surface 102 remains at a set height. If the weight of the load on the work surface 102 is within the predetermined range, as determined by the user, the load is considered balanced. When the load is balanced, the brake 44 can be disengaged. To disengage the brake 44, the user squeezes the brake release handle 58 which pulls the brake cable 46 so that the brake cable 46 pulls the brake release spring 48 and exerts a force on the brake release spring 48 in a direction away from the braking capstan 42. The brake release spring 48 overcomes the force of the out-of-balance springs 54 and 56 tending to hold the stop 50 in contact with the braking capstan 42 and pulls the stop 50 out of contact with the teeth 42A of the braking capstan 42. The guides 52 ensure that the stop 50 moves in an essentially straight direction. As the stop 50 moves away from the braking capstan 42, the stop 50 moves into the center portion of the opening 60A of the housing 60. Once the stop 50 is out of contact with the braking capstan 42, the braking capstan 42 is able to rotate freely so that the cables 34 and 36 of the anti-racking system 32 can move and the counterbalance apparatus 10 and be extended or compressed. If the stop 50 is in the out-of-balance position when the user attempts to disengage the brake 44, the stop 50 contacts either the upper or lower shoulder 60B or 60C of the opening 60A in the housing 60 which prevents the stop 50 from being moved out of contact with the teeth 42A of the braking capstan 42. Thus, the stop 50 continues to contact the braking capstan 42 to prevent the braking capstan 42 from rotating. The visibility of the stop 50 through the opening 60A of the housing 60 and the window 112 in the cover plate 110 enables a user to easily determine that the workstation 100 is out-of-balance, thus indicating that the brake 44 will not disengage. It is understood that the braking system would be similar for workstations 100 having more than two (2) legs.

The counterbalance apparatus 10 can be used to raise or lower a work surface 102 with minimal force even when the work surface 102 has a load. The counterbalance apparatus 10 is used to prevent the work surface 102 from raising or lowering suddenly if a load is added or removed from the work surface 102 such that the load is out-of-balance and is not within the predetermined range so that the adjusted pre-load force setting of the counterbalance apparatus 10 is incorrect. To move the work surface 102, the user exerts a small force on the work surface 102 in the direction the work surface 102 is to be moved. During vertical movement of the work surface 102, the inner column 14 of the counterbalance apparatus 10 telescopes in and out of the outer column 12. In the fully compressed, unextended position, with the work surface 102 in the lowermost position, the inner column 14 is essentially fully within the outer column 12, the spring 20 is in the compressed position, the second end 18B of the grooved member 18 is adjacent the second end 16B of the base member 16 and the first end 18A of the grooved member 18 is adjacent the first end 14A of the inner column 14. In the lowermost portion, the first rollers 14E are at the second end 18B of the first grooves 18E adjacent the center of the grooved member 18 and the second rollers 16D are at the second end 18B of the second grooves 18F adjacent the center of the grooved member 18.

To raise the work surface 102 from the lowermost position, the user exerts an upward force on the work surface 102. As the work surface 102 is moved vertically upward, and the spring 20 expands and the grooved member 18 moves out of the base member 16 and the inner column 14. The inner column 14 is lifted upward, out of the outer column 12. As the inner column 14 is moved upward, the first and second rollers 14E and 16D rotate within and follow along the first and second grooves 18E and 18F. In the initial unextended, or fully lowered position, the first and second rollers 14E and 16D are located at the second end 18B of the first and second grooves 18E and 18F adjacent the center of the grooved member 18. As the inner column 14 is lifted upward, the second rollers 16D follow the second grooves 18F toward the first end of the second grooves 18F at the second end 18B of the grooved member 18 while the first rollers 14E follow the first grooves 18E toward the first end of the first grooves 18E at the first end 18A of the grooved member 18. As the first and second rollers 14E and 16D move along the first and second grooves 18E and 18F, the first and second rollers 14E and 16D rotate about an axis perpendicular to the axis A-A of the counterbalance apparatus 10 to allow for travel of the first and second rollers 14E and 16D along the first and second grooves 18E and 18F. The force of the spring 20 pushing upward assists the lifting force of the user to allow the user to lift a work surface 102 having a greater weight by exerting a relatively small force. In addition, the downward force of the first grooves 18E on the first rollers 14E works against the upward force of the spring 20 such that the force exerted on the work surface 102 remains substantially constant throughout the complete movement of the work surface 102. The force on the first rollers 14E and consequently, on the first grooves 18E, changes as the compression of the spring 20 is changed. The greater the compression of the spring 20, the greater the load on the first grooves 18E. The first rollers 14E travel along the first grooves 18E which allows the first grooves 18E to carry a greater part of the force of the spring 20. The force on the second rollers 16D and consequently, on the second grooves 18F, remains substantially constant throughout the entire movement of the work surface 102 as a result of the adjusted pre-load force on the spring 20 and is directly related to the adjusted pre-load force. In one (1) embodiment, the curve of the first grooves 18E is non-linear and the spring is non-constant. In one (1) embodiment, the spring is non-linear such that the spring 20 does not compress evenly along its length and the force of the spring 20 is not linear. As the spring 20 is expanded and the first rollers 14E move along the first grooves 18E, the normal force exerted on the first rollers 14E changes direction to compensate for the change in force exerted by the spring 20. The first grooves 18E allow the force exerted on the work surface 102 to remain substantially constant by varying the force normal to the first rollers 14E to compensate for the varying force exerted by the spring 20 resulting from the expansion of the spring 20. The non-linear curve of the first grooves 18E creates a camming action between the first rollers 14E and the first grooves 18E which varies the normal force exerted on the first rollers 14E by the first groove 18E. The angle of the curve of the first grooves 18E allows the force needed to move the work surface 102 up and down to remain substantially constant regardless of the adjusted pre-load force on the counterbalance apparatus 10. The first rollers 14E move along the first grooves 18E to compensate for the changing force of the spring 20 to provide a substantially constant force output. In one (1) embodiment, the first grooves 18E carry the force of the spring 20 beyond the initial pre-load force ($F_0$). The slope of the curve of the first grooves 18E is directly related to the slope of the curve of the non-constant spring 20. The interaction of the spring 20 and the first rollers 14E allows for a substantially constant force acting on the work surface 102 along the entire length of movement of the work surface 102. In one (1) embodiment, a substantially constant force acts on the work surface 102 regardless of the weight of the load on the work surface 102. The relationship between the spring 20 and the first grooves 18E allows the second grooves 18F to have a linear slope. In one (1) embodiment, as the spring 20 expands, the first grooves 18E take a decreasing share of the force of the spring 20 while the second grooves 18F carry a constant share of the force. The angle of the curve of the second grooves 18F allows the work surface 102 to move with a substantially constant force. The second rollers 16D move along the second grooves 18F to counteract the constant adjusted pre-load force. The interaction of the spring 20 and the first and second rollers 14E and 16D on the first and second grooves 18E and 18F also provide a substantially constant torque throughout the entire movement of the work surface 102. Once the work surface 102 has reached the desired height, the user releases the brake release handle 58 so that the brake 44 is automatically engaged.

The operation of the counterbalance apparatus 10 is the same but opposite for lowering the work surface 102 as for raising the work surface 102. To lower the work surface 102 having the counterbalance apparatus 10, the user exerts a force downward on the work surface 102 which compresses the spring 20. As the spring 20 compresses, the spring 20 exerts an increasingly greater upward force on the work surface 102. In response to the upward force of the spring 20, the first grooves 18E in the grooved member 18 exert an upward force on the first rollers 14E of the inner column 14 and the second grooves 18F exert an upward force on the second rollers 16D. The first and second rollers 14E and 16D travel on the first and second grooves 18E and 18F such that the first and second grooves 18E and 18F are carrying the force of the spring 20.

In the foregoing description, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated by reference herein in their entirety, with each claim standing on its own as a separate embodiment of the present invention.

It is intended that the foregoing description be only illustrative of the present invention and that the present invention be limited only by the hereinafter appended claims.

I claim:

1. A counterbalance apparatus, which comprises:

a) an outer column;

b) an inner column slidably mounted in the outer column and having an inner bore with a first roller in the inner bore;

c) a base member positioned in the outer column and having an inner bore with a second roller in the inner bore;

d) a grooved member movably mounted in the inner bore of the base member and the inner bore of the inner column and having a first end and a second end with an inner bore and a sidewall extending therebetween and having a first groove in an outer surface of the sidewall to receive the first roller of the inner column and a second groove in the outer surface of the sidewall; to receive the second roller of the base member and e) a force mechanism extending between the grooved member and the inner column.

2. The counterbalance apparatus of claim 1 wherein the sidewall of the grooved member has a cylindrical shape and wherein the first groove and the second groove have a spiral orientation in the outer surface of the sidewall of the grooved member.

3. The counterbalance apparatus of claim 1 wherein the inner column has three first rollers mounted in the inner bore, wherein the grooved member has three first grooves in the outer surface of the sidewall and wherein the three first rollers are adapted to move along the three first grooves as the counterbalance apparatus is compressed and extended.

4. The counterbalance apparatus of claim 3 wherein the inner bore of the inner column has a cylindrical shape and wherein the three first rollers are radially spaced apart approximately 120° in the inner bore.

5. The counterbalance apparatus of claim 1 wherein the first groove is non-linear.

6. The counterbalance apparatus of claim 1 wherein the base member has three second rollers mounted in the inner bore, wherein the grooved member has three second grooves in the outer surface of the sidewall and wherein the three second rollers are adapted to move along the three second grooves as the counterbalance apparatus is compressed and extended.

7. The counterbalance apparatus of claim 6 wherein the inner bore of the base member has a cylindrical shape and wherein the three second rollers are radially spaced apart approximately 120° in the inner bore.

8. The counterbalance apparatus of claim 1 wherein the second groove is linear.

9. The counterbalance apparatus of claim 1 wherein the force mechanism is positioned in the inner bore of the grooved member.

10. The counterbalance apparatus of claim 1 wherein the force mechanism is a spring.

11. The counterbalance apparatus of claim 10 wherein the spring includes multiple springs connected together.

12. The counterbalance apparatus of claim 10 wherein the spring has opposed first and second ends and is positioned in the inner bore of the grooved member so that the second end of the spring is adjacent the second end of the grooved member and the first end of the spring extends beyond the first end of the grooved member.

13. The counterbalance apparatus of claim 10 wherein the spring has opposed ends with an inner bore extending therebetween, wherein an adjustment rod is mounted in the inner bore of the spring, wherein the adjustment rod has an adjustment nut adjacent one end of the spring and wherein the adjustment nut is adapted to move along the adjustment rod to compress the spring to vary a pre-load on the spring.

14. The counterbalance apparatus of claim 1 wherein the outer column has an inner passageway and wherein the inner passageway has guides which are adapted to contact the inner column.

15. The counterbalance apparatus of claim 1 wherein the inner column has guides which are adapted to engage the outer column.

16. The counterbalance apparatus of claim 1 wherein a size of the base member is less than a size of the inner column so that when the counterbalance apparatus is in an unextended position, the base member extends into the inner column.

17. A workstation which comprises:

a) a work surface;

b) a base; and c) one leg extending between and connecting the work surface and the base and having a counterbalance apparatus, the counterbalance apparatus including an outer column, an inner column connected to the work surface and slideably mounted in the outer column and having a first roller, a base member positioned in the outer column and having a second roller, a grooved member movably mounted in the base member and the inner column with a first end and a second end with a sidewall extending therebetween and having a first groove in an outer surface of the sidewall to receive the first roller of the inner column and a second groove in the outer surface of the sidewall, to receive the second roller of the base member and a force mechanism extending between the grooved member and the inner column.

18. The workstation of claim 17 wherein the workstation has a single leg, wherein the inner column has an anti-torquing roller positioned on the outer surface, and wherein the anti-torquing roller is configured to engage the outer column to prevent the inner column and the work surface from rotating as the grooved member rotates.

19. A workstation having a load, which comprises, a) a work surface;

b) a base; and c) at least two legs extending between and connecting the work surface and the base wherein each of the legs includes a counterbalance apparatus, the counterbalance apparatus including an outer column, an inner column connected to the work surface and slideably mounted in the outer column and having a first roller, a base member positioned in the outer column and having a second roller, a grooved member movably mounted in the base member and the inner column with a first end and a second end with a sidewall extending therebetween and having a first groove in an outer surface of the sidewall to receive the first roller of the inner column and a second groove in the outer surface of the sidewall, to receive the second roller of the base member and a force mechanism extending between the grooved member and the inner column.

20. The workstation of claim 19 wherein an anti-racking system connects the counterbalance apparatus in each of the legs of the workstation so that the counterbalance apparatus operate together to raise and lower the work surface.

21. The workstation of claim 20 wherein the workstation has a first leg with a first counterbalance apparatus and a second leg with a second counterbalance apparatus, wherein the anti-racking system includes a first cable extending from an end of the inner column of the first counterbalance apparatus around a first pulley adjacent the first counterbalance apparatus and along and around a braking capstan to a second pulley adjacent the second counterbalance apparatus and to the work surface and a second cable extending from an end of the inner column of the second counterbalance apparatus around the second pulley adjacent the second counterbalance apparatus and along and around the braking capstan and around the first pulley adjacent the first counterbalance apparatus to the work surface and wherein the first cable is connected to the second cable adjacent the work surface and tensioned.

22. The workstation of claim 21 wherein a brake is provided to prevent rotation of the braking capstan and prevent the counterbalance apparatus from moving to prevent the work surface from being raised or lowered.

23. The workstation of claim 22 wherein the braking capstan has teeth around a perimeter, wherein the brake includes a stop connected to a brake cable connected to a brake handle and wherein when the brake is engaged, the stop extends between the teeth of the braking capstan to prevent the braking capstan from rotating.

24. The workstation of claim 23 wherein the brake includes out-of-balance springs connected to a first side and a second side of the stop and wherein when a weight of the load on the work surface is within a pre-determined range, the out-of-balance springs hold the stop in a balanced position.

25. The workstation of claim 23 wherein the brake has a housing, wherein the stop of the brake extends through an opening in the housing, wherein the opening in the housing has a center portion with out-of-balance shoulders adjacent the center portion, and wherein when the weight of the load on the work surface is not within the pre-determined range, the stop is configured to contact one of the out-of-balance shoulders so that the out-of-balance shoulder prevents the stop from being moved out of contact with the braking capstan.

26. A method of preventing a work surface of a workstation from being raised or lowered when a weight of a load on the work surface is outside of a predetermined range, which comprises the steps of:

a) providing at least a first leg and a second leg extending between and connecting the work surface and a base of the workstation;

b) providing a counterbalance apparatus positioned in each of the first and second legs of the workstation, the counterbalance apparatus including an outer column, an inner column connected to the work surface and slideably mounted in the outer column and having a first roller, a base member positioned in the outer column and having a second roller; a grooved member movably mounted in the base member and the inner column with a first end and a second end with a sidewall extending therebetween and having a first groove in an outer surface of the sidewall to receive the first roller of the inner column and a second groove in an outer surface of the sidewall to receive the second roller of the base member; and a force mechanism extending between the grooved member and the inner column;

c) providing an anti-racking system extending between and connecting the counterbalance apparatus in each of the first and second legs of the workstation;

d) providing a brake having a stop, a brake release spring connected to the stop, a braking capstan having teeth and a brake cable connected between the brake release spring and a brake handle and having out-of-balance springs connected to a first side and a second side of the stop;

e) providing a housing for the brake, the housing having an opening with a center portion having out-of-balance shoulders adjacent the center portion, wherein the stop for the brake extends through the opening in the housing, and wherein when the weight of the load on the work surface is within the predetermined range, the out-of-balance springs exert a force on the stop to hold the stop in a balanced position so that the stop is positioned in the center portion of the opening in the housing; and f) squeezing the brake handle to disengage the brake so that the brake cable exerts a force on the brake release spring in a direction away from the braking capstan to move the stop away from the braking capstan so that the stop moves in the center portion of the opening in the housing and out of contact with braking capstan.

27. The method of claim 26 wherein the anti-racking system includes a first cable extending from an end of the inner column of the first counterbalance apparatus around a first pulley adjacent the first counterbalance apparatus and along and around the braking capstan to a second pulley adjacent the second counterbalance apparatus and to the work surface and a second cable extending from an end of the inner column of the second counterbalance apparatus around the second pulley adjacent the second counterbalance apparatus and along and around the braking capstan and around the first pulley adjacent the first counterbalance apparatus to the work surface, wherein the first cable is connected and tensioned to the second cable adjacent the work surface, and wherein in step (f), when the stop engages the braking capstan, the stop prevents the braking capstan from rotating which prevents the first and second cables of the anti-racking system from moving.

28. The method of claim 26 wherein when the weight of the load on the work surface is outside of the predetermined range, the force of the out-of-balance springs is overcome so that the stop is moved to an out-of-balance position and wherein in step (f), when the stop moves away from the braking capstan, the stop contacts one of the out-of-balance shoulders adjacent the center portion of the opening of the housing to prevent the stop from being moved out of contact with the braking capstan so that the stop remains engaged between the teeth of the braking capstan.

* * * * *